United States Patent [19]

Horvath

[11] 3,982,364

[45] Sept. 28, 1976

[54] PREFABRICATED SUPPORT AND FLOOR SYSTEM FOR BUILDING

[75] Inventor: Louis W. Horvath, Huntsville, Ala.

[73] Assignee: Spaceair Products, Inc., Huntsville, Ala.

[22] Filed: Aug. 23, 1974

[21] Appl. No.: 500,129

[52] U.S. Cl. ..... 52/126; 52/241; 52/403

[51] Int. Cl.[2] ..... E04D 15/00; E04B 7/02

[58] Field of Search ..... 52/295, 126, 169, 713, 52/90, 403, 586, 723, 294, 274, 292, 299, 293, 499, 281, 583, 264, 241

[56] References Cited

UNITED STATES PATENTS

| | | | |
|---|---|---|---|
| 2,138,958 | 12/1938 | Corbett | 52/241 |
| 2,733,785 | 2/1956 | Beatty | 52/295 |
| 3,150,748 | 9/1964 | Liskey | 52/403 |
| 3,353,863 | 11/1967 | Koot | 52/264 |
| 3,425,179 | 2/1969 | Haroldson | 52/126 |
| 3,470,663 | 10/1969 | Tate | 52/126 |
| 3,487,598 | 1/1970 | Lopina | 52/241 |
| 3,611,650 | 10/1971 | Horvath | 52/90 |
| 3,798,860 | 3/1974 | Mason | 52/241 |

*Primary Examiner*—Price C. Faw, Jr.
*Assistant Examiner*—Robert C. Farber
*Attorney, Agent, or Firm*—Dawson, Tilton, Fallon & Lungmus

[57] ABSTRACT

A floor structure includes a plurality of height-adjustable ground pad or anchor assemblies which either rest on or are embedded in the ground and which are laid out to define a grid. The top of each ground pad and anchor assembly is provided with a casting which includes laterally extending support flanges to which floor panel receivers are pinned to the ground pads and anchor assemblies along the grid pattern. The floor panel receivers include elongated horizontal channels, open at the top for receiving tongues on the peripheral framework of individual floor panels. Floor joints fill the openings between panels. A separate peripheral wall support base provides a channel for receiving a wall panel, and it is tied to the ground pads or anchors.

3 Claims, 12 Drawing Figures

Fig. 1
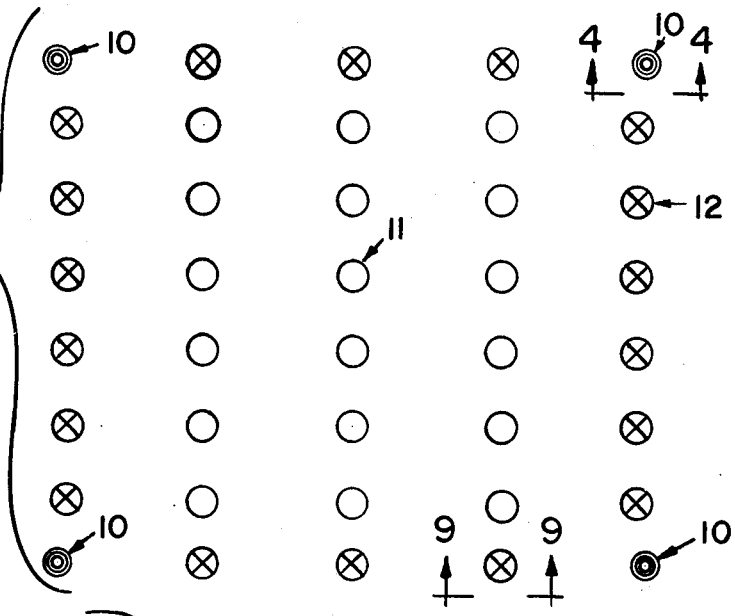
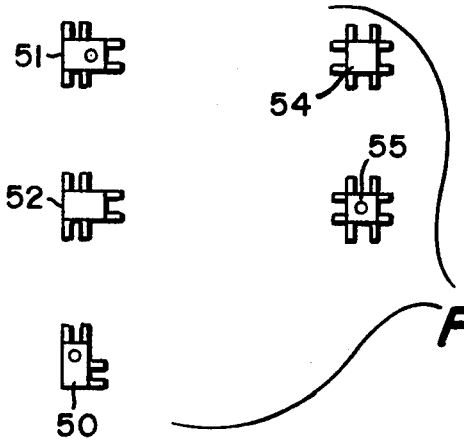
Fig. 2
Fig. 4
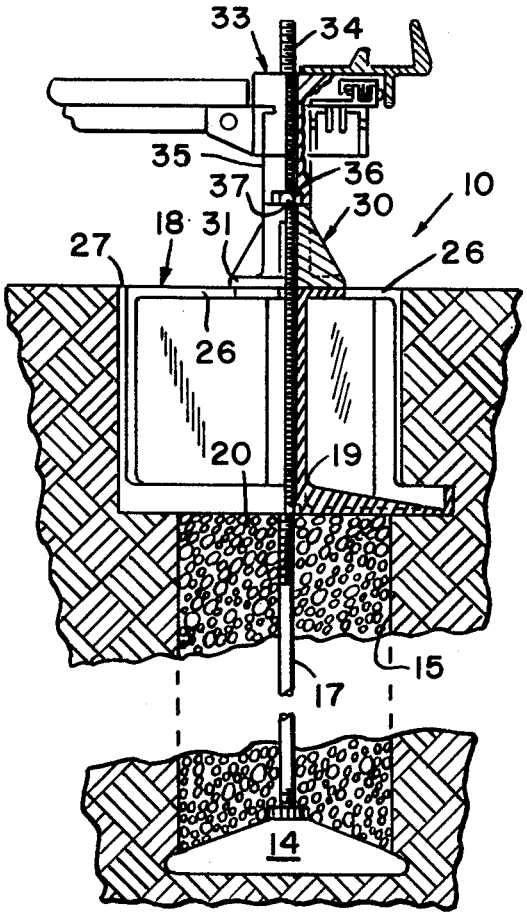
Fig. 3
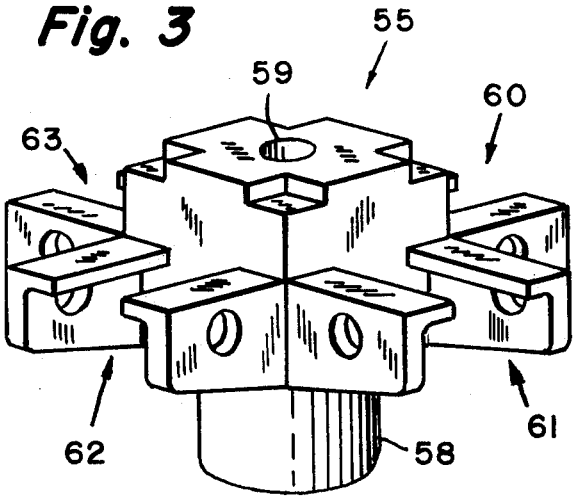

Fig. 5
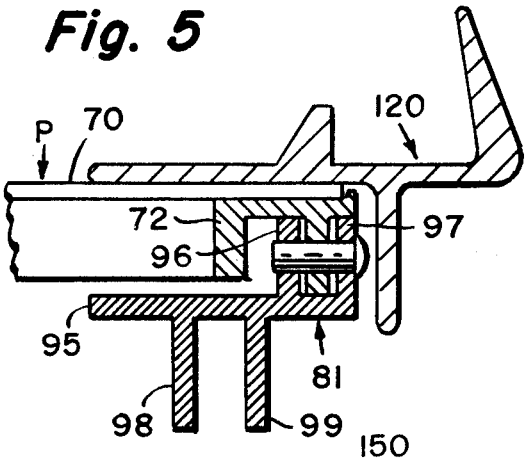
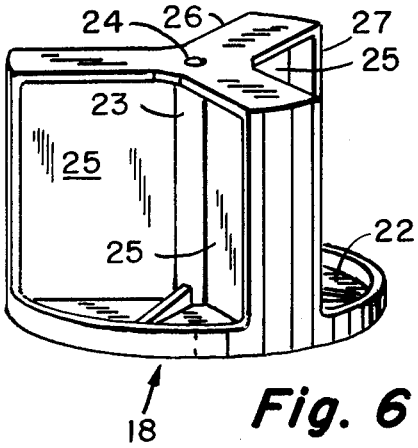
Fig. 6
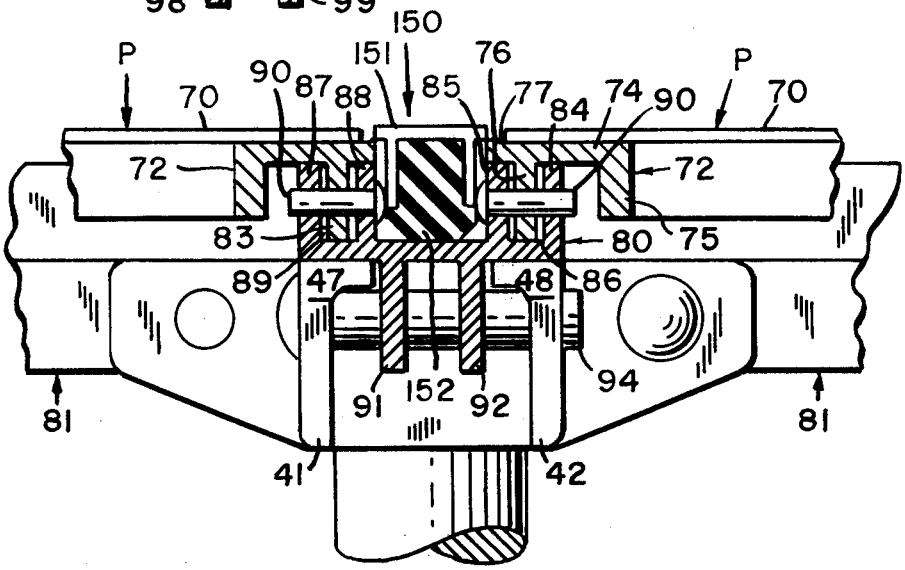
Fig. 7
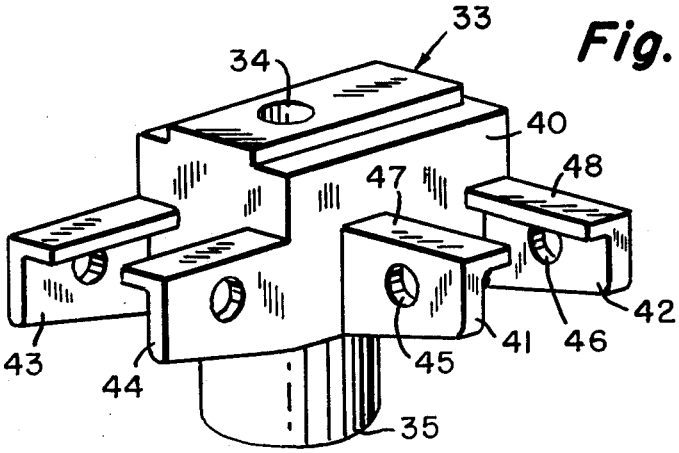
Fig. 8

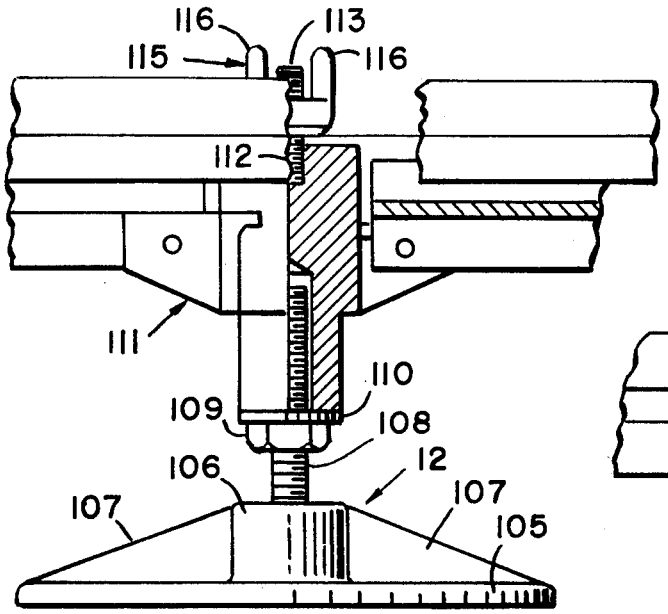
Fig. 9
Fig. 10
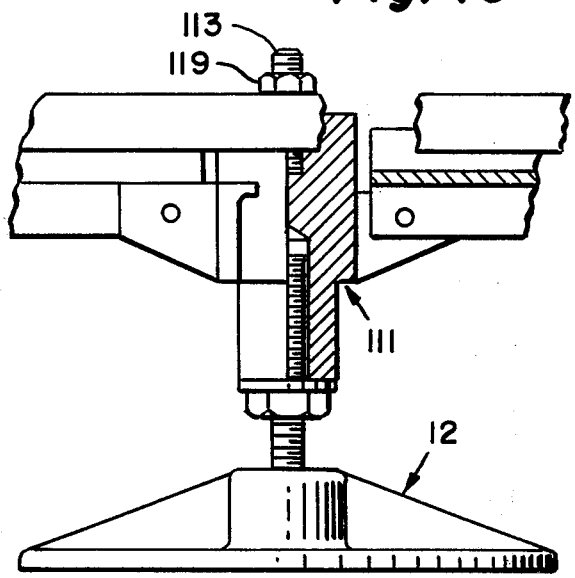
Fig. 11
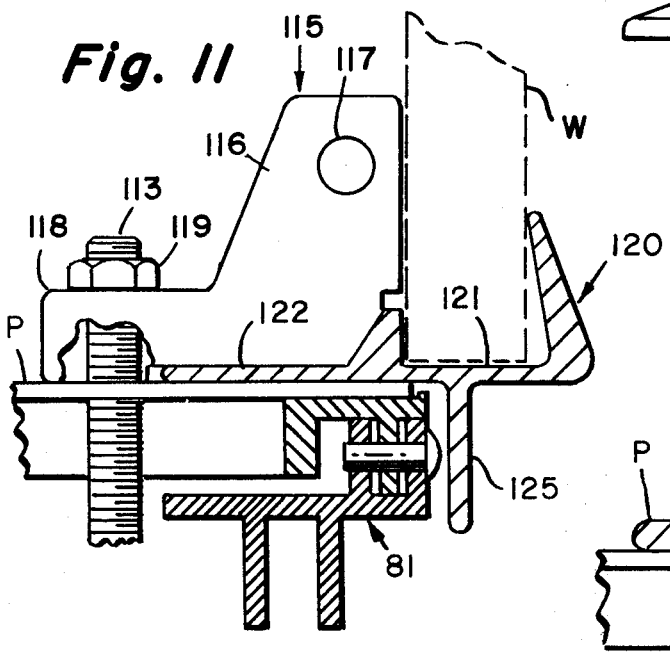
Fig. 12
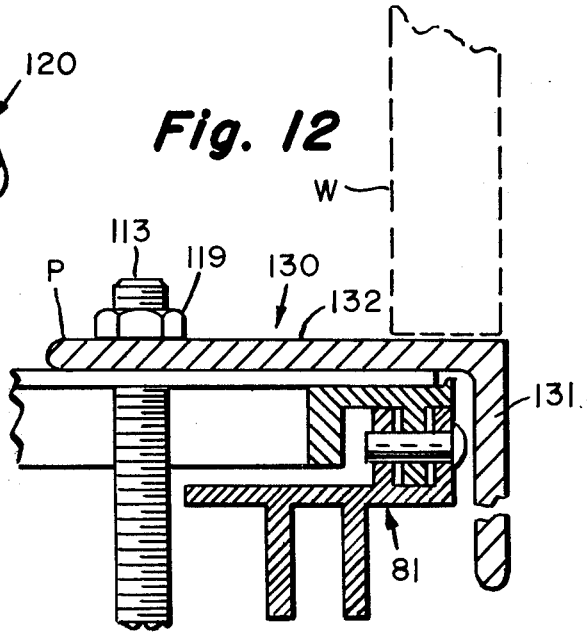

PREFABRICATED SUPPORT AND FLOOR SYSTEM FOR BUILDING

BACKGROUND AND SUMMARY

The present invention relates to a building floor structure; and more particularly, it relates to a floor structure which is prefabricated.

There are many uses for buildings, such as for sheltor or storage, shelter it is desirable to be able to erect the building in a very short time and in almost any location which is leveled. Normal construction techniques using footings, foundations and conventional studded frameworks are not only expensive, but they are time-consuming and require workers skilled in many different trades, thereby presenting a scheduling problem.

In the present invention, a raised floor structure is provided which is prefabricated, relatively inexpensive, and may be assembled on the site in a minimum of time, using only a relatively small number of standard parts which are used repeatedly. Walls and sealings may be applied to the structure in accordance with the teachings of my U.S. Pat. Nos. 3,611,650 and 3,762,117.

The floor structure of the present invention includes a plurality of height-adjustable ground pads or anchors which either rest on or are embedded into the ground. The anchor assemblies are used to secure the floor structure and building to the ground, whereas the ground pads are used primarily as support for the floor and building. As many anchor assemblies are used as are deemed necessary to secure the building, depending upon the weather conditions for the location at which it is assembled.

The ground pads and anchor assemblies are laid out in a rectangular grid fashion. The top of each ground pad and anchor assembly is provided with a casting which includes laterally extending support flanges. Floor panel receivers, which preferably take the form of a continuous elongated metallic extrusion, are pinned to the ground pads and anchor assemblies along the grid network. The floor panel receivers provide elongated horizontal channels, open at the top, for receiving tongues on the peripheral framework on individual floor panels. Floor joints fill the openings between the panels, after assembly to the receivers.

A separate peripheral wall support base provides a channel for receiving a wall panel, and it is secured to the ground pads for anchors. If desired, the user may employ his own wall construction, in which case, a separate wall base is used which does not provide a channel, but which is secured to the ground pads or anchors.

Once a site is leveled, the ground pads and anchor assemblies are laid out according to design. Each of the ground pads and anchor assemblies is adjustable for leveling the floor. Once these are laid out, the floor panel receivers are secured between adjacent ground supports, by means of pins which may be self-locking, if desired.

Next, the floor panels are assembled to the receivers, the peripheral wall support base extrusions are secured, and the floor joints are filled.

Because all of the dimensions can be very accurately determined in the floor panels, floor panel receivers, and so on, assembly on the site is greatly facilitated. Further, relatively few number of parts are used, and because the dimensions are standardized, such parts are interchangeable. Hence, there is little or no time lost in sorting out the parts at the site. Assembly of the parts is greatly facilitated due to the simplicity of the structure, and the amount of skill or experience needed to secure and assemble the floor structure is minimized.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 1 is a schematic plan view showing one illustrative layout of ground supports for a floor;

FIG. 2 is a plan view showing the various types of upper connector castings used in the different locations on the ground supports of FIG. 1;

FIG. 3 is a perspective view of a connector casting for an interior location;

FIG. 4 is a side elevational view partly in cross section and partly broken away, of an anchor assembly;

FIG. 5 is a close-up fragmentary cross sectional view of the edge of an assembled floor incorporating the present invention, including floor panel, panel receiver, and preferred wall based support;

FIG. 6 is an upper perspective view of a paddle wheel used in the anchor assemblies;

FIG. 7 is a close-up fragmentary cross sectional view of the joint between adjacent floor panels, illustrating how they are attached;

FIG. 8 is an upper perspective view of an upper connector casting for ground support used in a corner position of the layout of FIG. 1;

FIG. 9 is a side view, partially broken away and partially shown in cross section of a ground pad assembly using a preferred wall support base;

FIG. 10 is a view similar to FIG. 9, but with an alternative wall support base;

FIG. 11 is a close-up view in cross section of the preferred wall support base and it attachment to an anchor rod; and FIG. 12 is a view similar to FIG. 11, but using an alternative wall support base.

DETAILED DESCRIPTION

Referring first to FIG. 1, there is shown a plan view of a layout for ground support means for a support and floor system for a building. In general, there are two types of floor support means used, one type is referred to as an anchor assembly, and these are generally designated by the reference numeral 10, and located only in the four corners of the building. The anchor assemblies 10 are shown in more detail in FIG. 4, and will be discussed below. The other type of ground support means is referred to as a ground pad, and these are located at the remaining 36 locations for the 4 × 8 rectangular gridwork along which the ground support means are located. The interior ground pads are designated by reference numeral 11, and represented by a circle. As will be discussed, the floor simply rests on the interior ground pads. The remaining ground pads, such as the one designated 12 are located on the periphery of the gridwork, and these are represented by a circle with a X in the center.

The principal differences between the ground pads 11 and 12 are first, the upper connector assemblies are slightly different because of the different number of interconnections to panel receivers that are necessary for the different locations, and secondly the upper connector assemblies for the ground pads located at the peripheral locations as at 12 are modified in such a manner that the wall may be secured directly to the ground pads, if desired. In an alternative embodiment, the walls themselves may not be secured directly to the ground pads, but a special extrusion which supports the wall is secured to the ground pads 12.

Obviously, different combinations of the various types of ground support means 10, 11 and 12 may be employed other than the one shown in FIG. 1, which is for illustrative purposes only. For example, a greater number of anchor assemblies 10 may be used than the four shown, if it is desired to attach the building more securely to the ground, as in areas of high wind or sever weather. Similarly, less than all of the peripheral locations 12 may be used to secure the walls to the ground support means.

Referring now to FIG. 4, the anchor assemblies 10 include a base plate 14 which is located at the bottom of a borehole indicated by reference numeral 50 formed in the ground to a predetermined desirable depth, which may be three feet or more, depending upon the requirements. Extending upwardly of the base 14 is an anchor rod 17, at the top of which is located a paddle wheel generally designated 18. The lower central portion of the paddle wheel 18 includes a cavity 19 fitted to receive a nut 20 which is threadedly engaged on the upper portion of the anchor rod 17.

An individual paddle wheel is seen in FIG. 16 as including a rimmed base plate 22, a central upright column or sleeve 23 which defines a central aperture 24 through which the anchor rod 17 is fitted, and three laterally extending webs 25. The webs 25 are located with upper flanges 26 and edge flanges 27. In assembling the paddle wheel 18 to the anchor rod 17, the nut 20 is first threaded onto the top of the anchor rod 17, and then the paddle wheel 18 is assembled so that the cavity 19 may be used as a socket for turning the nut 20 to achieve the desired height of the upper flanges 26 of the paddle wheel.

Crushed stone is placed on top of the base 14 to fill the borehole, and it may also be used to surround the paddle wheel 18 once its height is properly adjusted.

Still referring to FIG. 4, the anchor rod 17 extends above ground level, and a spacer 30 is located above it, including a base plate 31 which rests on the horizontal flanges 26 of the paddle wheel 18. On top of the spacer 30 and received on the anchor rod 17 is an upper connector casting 33 which includes a continuous vertical apertuer 34 through which the anchor rod 17 is received.

The casting 33 includes a central vertical bore 34 through which the anchor rod 17 is received. It also includes a lower hub or sleeve 35, the bottom surface of which is provided with a socket 36 in which a nut 37 is located. Thus, the connector castings 33 may be used to turn the nut 37 down on the anchor rod 17 to secure the spacer member 30.

It will be appreciated that the connector casting 33 is located at a corner position of the floor support assembly, and it is seen in perspective in FIG. 8. As seen there, located above the hub 35 is a body portion 40. A first pair of flanges 41, 42 extend in one orthogonal direction defined by a side of the building, and a second pair of flanges 43, 44 extend in a second orthogonal wall direction. These pairs of flanges are adapted to secure floor panel receivers, as will be described presently. Each flange includes a horizontal aperture, designated respectively 45, 46 for the flanges 41, 42, and an inwardly turned horizontal flange or gland, designated respectively 47, 48 for the flanges 41, 42. The body portions of the flanges are vertical, as illustrated.

A pair of cooperating flanges 41, 42 or 43, 44 are sometimes hereinafter referred to as a pair of tie flanges because, as mentioned, each pair is used for securing or typing an associated panel receiver to the ground support means.

Referring now to FIG. 2, it will be observed that a connector assembly at the corner position 50 is provided with two pair of tie flanges extending in orthogonal directions. The connector castings 51, 52 which are located at the intermediate wall positions are provided with three pair of tie flanges, and the interior connector castings 54, 55 are provided with four pair of tie flanges, each located at a 90° angle relative to an adjacent pair of tie flanges. Not all of the connector assemblies need be provided with a continuous central aperture for securing it to an associated ground support means, however, those designated 50, 51 and 55 are so provided. An interior connector casting such as the one designated 55 is shown in perspective in FIG. 3, the hub being designated 58, the central aperture 59, and the four pair of tie flanges designated respectively 60–63.

Turning now to FIGS. 5 and 7, the floor panels are designated P, and each includes a sheet of material 70 which provides the actual floor surface, and a peripheral frame extrusion 72 which extends on all four sides beneath the sheet 70. The extrusion frames 72 have the same shape except that for opposite sides of the panel P, they are turned around to form better images. Referring specifically to the frame 72 for the right side panel in FIG. 7, it includes a horizontal portion 74, an interior vertical portion 75, an intermediate vertical portion 76 spaced from the vertical portion 75, and a slightly upwardly turned outer edge 77, thus forming the general shape of an F.

Still referring to FIGS. 5 and 7, there are, in general, two shapes of panel receivers, both of which are preferably metal extrusions. One type of panel receiver is generally designated 80 in FIG. 7 and is used for all interior locations, extending between adjacent ground support means to complete the lattice of the gridwork of FIG. 1. The other type of panel receiver is generally designated by reference numeral 81 in FIG. 5, and it is used at all peripheral locations in the gridwork of FIG. 1.

The panel receiver 80 includes a horizontal flange 83, a first pair of upright side flanges 84, 85 which are spaced laterally apart and extend from the upper surface of the horizontal flange 83 to provide an elongated horizontal channel designated 86. A similar pair of vertical flanges 87, 88 are located at the other edge of the horizontal flange 83, and they cooperate to define a horizontally elongated channel 89. Each of the channels 86, 89 are used to receive a center leg 76 of an associated panel frame member 72 which is pinned thereto by means of a pin 90.

A third pair of vertical flanges 91, 92 extend from the bottom of the horizontal flange 83 of the panel receiver 80, and they are spaced to fit between an associated pair of tie flanges 41, 42 to which they are secured by means of a pin 94, fitted through the aligned apertures 45, 46 of the tie flanges. The horizontal flange 83 of the panel receiver 80 rests on the inwardly turned support flanges 47, 48 previously described.

The peripheral panel receiver 81, seen in FIG. 5, is similar in structure to the interior panel receiver just described, except that it does not include the innermost pair of upper flanges corresponding to those designated 87, 88. That is, it includes a horizontal flange 95, a pair of upright flanges 96, 97 at one edge thereof, and a pair of lower vertical flanges 98, 99 for attachment to a pair of tie flanges on a connector casting. The panel frame 72 is thus attached to the outermost flanges.

Referring now to FIGS. 9 and 11, a peripheral ground pad generally designated 12 includes a base plate 105 which sets on the ground and is provided with a central hub 106 and a plurality of radial flanges 107. The hub 106 defines a ball socket for receiving the ball end of a threaded rod 108. A nut 109 is threaded onto the rod 108, and a heavy stop washer 110 rests on the upper surface of the nut 109 for supporting a connector casting generally designated 111. The upper portion of the connector casting 111 includes an internally threaded hole 112 which receives a stud 113 to which is secured a wall connector casting 115. The wall connector casting 115 includes laterally spaced upright ears 116 which are provided with aligned apertures 117, and a base portion 118 which is also apertured for fitting over the stud 113. A nut 119 holds the base portion and thus the wall connector casting 115 securely in place to the ground pad 12. The aligned apertures 117 are used to pin a wall panel generally designated W and shown in dashed line in FIG. 11 to the structure. The wall panel W is received in a wall support base generally designated 120 which is an elongated metal extrusion. The wall support base 120 defines a channel 121 for receiving the wall panel W. It also includes a foot portion 122 which is interposed between the floor panel P and the wall connector casting 115, where it is securely held. It also includes a skirt portion 125 for covering the pin attachments of the floor panels P to the peripheral floor panel receivers 81. The embodiment of FIGS. 9 and 11 is designed for use with the wall panels and roof structure of my above-identified patents. If this wall structure is not being embodiment of FIGS. 10, 12 may be used. Here, a simple L-shaped wall base support designated 130 is used for supporting a wall panel, again designated W and shown in dashed line. The wall support base 130 again includes a covering skirt 131 and a horizontal foot portion 132 which is apertured to be fitted over the threaded stud 113 and secured by the nut 119.

The connector casting 111 thus merely rests on the washer 110, the weight of the building and its contents holding it down. For the interior locations, the connector castings do not have to be provided with the upper internally threaded hole 112 because the floor panels are secured to the pair of tie flanges at each location.

In summary, the present invention provides for a prefabricated support and floor system for a building which includes a number of ground support means load out in a rectangular gridwork. Some of the ground support means may be anchors of the type generally designated 10 and shown in FIG. 4 where a major portion of the anchor is embedded in the ground. Again, the number of such anchor means depends upon the environment in which the building is to be used. The remainder of the ground support means are ground pads, resting on the ground, but not tied to it, and including a ball joint so that the floor will be level when assembled. There are two types of ground pads, depending upon whether they are used on the periphery of a building or at the interior of the gridwork. Each of the ground pads, as well as the anchor assemblies includes a connector casting to which the panel receiver extrusions are pinned.

The connector castings for the peripheral locations include an internally threaded aperture so that a wall base support may be rigidly secured to it, by means of the studs 113 and nuts 119. A wall support base of the type designated 120 in FIG. 11 or 130 in FIG. 12 may be used, depending upon the superstructure of the building.

Each floor panel includes a continuous peripheral frame 72 defining a vertical intermediate flange which is received in an associated channel of a panel receiver extrusion and pinned to it.

The separation between adjacent panels is covered by a joint insert member generally designated by reference numeral 150 in FIG. 7 and including a metallic extrusion 151 which is formed in the shape of the Greek letter "pi" and tc which is bonded a neoprine filler 152. The sides of the extrusion 151 may be used to retain the pins 90 in place, if they are not self-locking pins, although the latter are preferred. The resilient filler 152 cushions sound transmission when the insert is walked upon.

For extremely cold environments, such as in the artic north, where the ground pads rest on frozen ground, heat transmission from the building may be reduced by making the nuts 109 supporting the connector castings of an insulating material such as nylon. It will be observed that the threaded rod 108 does not have intimate contact with the internal bore of the connector casting, and this provides a convenient means of reducing heat losses in an environment of this type.

Having thus described in detail a preferred embodiment of the present invention, persons skilled in the art will be able to modify certain of the structure which has been illustrated and substitute equivalent elements for those disclosed while continuing to practice the principle of the invention; and it is, therefore, intended that all such modifications and substitutions be covered as they are embraced within the spirit and scope of the appended claims.

I claim:

1. A prefabricated support and floor system comprising: a plurality of ground support means arranged in a rectangular grid, each ground support means including connecting means providing tie flange means extending toward adjacent ground support means; a plurality of panel receiver means each connected at its ends to the tie flange means of adjacent ground support means, each panel receiver means comprising an elongated extrusion including a horizontal flange, depending central flanges extending downwardly of said horizontal flange and received in a pair of tie flange means on associated connector means, and at least one pair of horizontally elongated flanges extending upwardly of said horizontal flange and defining a horizontally elongated channel; a plurality of floor panel means, each including sheet material providing a floor and a peripheral frame defining a tongue flange received in an associated channel of associated panel receiver means and secured thereto; and wall support base means secured to and extending between adjacent ones of said ground support means and extending continuously around the periphery of said gridwork for supporting the upright walls of a building.

2. The apparatus of claim 1 wherein said ground support means comprises a plurality of anchor means embedded in the ground and including an upright threaded anchor rod, a paddle wheel anchor on said rod and beneath ground level providing an upper flange at ground level, spacer means on said rod resting on said ground level flange of said paddle wheel, a nut on said rod above said spacer means for securing the same, and a connector casting above said nut, said connector casting providing a plurality of orthogonally oriented pairs of tie flanges, each tie flange including a pair of spaced upright flanges with inwardly turned upper flanges spaced to receive an associated panel receiver means.

3. The apparatus of claim 1 wherein said anchor means comprises a plurality of ground pads, each ground pad comprising a base resting on the ground and providing a hub defining a ball socked, a threaded rod extending upwardly of said hub and defining a ball received in said socket; a connector casting receiving the upper end of said rod; internally threaded nut means on said rod and adjustable therealong providing a support for said connector casting, said connector casting providing a plurality of said tie flange means for receiving associated panel receiver means.

* * * * *